US010932562B2

(12) United States Patent
Romano et al.

(10) Patent No.: US 10,932,562 B2
(45) Date of Patent: Mar. 2, 2021

(54) ARTICLE OF FURNITURE

(71) Applicant: King Furniture Australia Pty Ltd., Turrella (AU)

(72) Inventors: Joseph Romano, Turrella (AU); Tom Fereday, Turrella (AU); David Hardwick, Turrella (AU)

(73) Assignee: King Furniture Australia Pty Ltd., Turrella (AU)

( * ) Notice: Subject to any disclaimer, the term of this patent is extended or adjusted under 35 U.S.C. 154(b) by 0 days.

(21) Appl. No.: 16/440,500

(22) Filed: Jun. 13, 2019

(65) Prior Publication Data

US 2020/0390236 A1 Dec. 17, 2020

(51) Int. Cl.
*A47B 21/06* (2006.01)
*A47B 83/04* (2006.01)

(52) U.S. Cl.
CPC ..... *A47B 21/06* (2013.01); *A47B 83/045* (2013.01); *A47B 2021/066* (2013.01); *A47B 2200/008* (2013.01)

(58) Field of Classification Search
CPC ..... A47B 2200/008; A47B 21/06; A47B 2021/066; A47B 2200/08; A47B 3/06; A47B 2013/022; A47B 47/0083
USPC ..... 108/50.02, 50.01, 155, 156, 153.1, 180, 108/186, 192
See application file for complete search history.

(56) References Cited

U.S. PATENT DOCUMENTS 2,802,575 A * 8/1957 Harrison ..... B65G 1/07 108/106
2,852,221 A * 9/1958 Steiner ..... A47B 13/021 248/188
3,749,343 A * 7/1973 Marschak ..... A47B 57/44 248/188
3,958,517 A * 5/1976 Jay ..... A47B 13/06 108/159
3,993,005 A * 11/1976 Burr ..... A47B 13/021 108/156
4,351,246 A * 9/1982 Hutchins, Jr. ..... A47B 47/06 108/156
5,934,203 A * 8/1999 Glass ..... A47B 13/003 108/156
5,974,985 A * 11/1999 Flototto ..... A47B 13/003 108/157.18
6,082,840 A * 7/2000 Chau ..... A47B 21/06 108/50.02

(Continued)

OTHER PUBLICATIONS

Lampiran 1, TANA Dining Table product sheet, cited in related Malaysian Design Application No. 18-01112-0101, displayed publicly on Nov. 20, 2017 during the International Furniture Fair, disclosed to Applicant Aug. 13, 2020.

*Primary Examiner* — Jose V Chen
(74) *Attorney, Agent, or Firm* — Banner & Witcoff, Ltd.

(57) ABSTRACT

An article of furniture includes a top member defining a planar work surface. A support structure supports the top member in spaced relationship relative to a floor, the support structure including a plurality of legs. At least one of the legs defines a socket having an opening at a top of at least one of the legs. A power connector is arranged within the socket of at least one of the legs. The power connector is configured to make electrical contact with an electrical connector of an electrical accessory when the electrical connector is received in the socket of at least one of the legs.

12 Claims, 8 Drawing Sheets

(56) References Cited

U.S. PATENT DOCUMENTS

| | | | | |
|---|---|---|---|---|
| 6,247,770 | B1 * | 6/2001 | Glass | A47B 57/44<br>108/107 |
| 6,283,043 | B1 * | 9/2001 | Stern | A47B 13/06<br>108/50.02 |
| 6,450,107 | B1 * | 9/2002 | Sanz Novales | A47B 13/003<br>108/153.1 |
| 7,634,967 | B1 * | 12/2009 | Albright | H02G 3/386<br>108/50.02 |
| 8,186,281 | B2 * | 5/2012 | Bastian | A47B 21/06<br>108/50.02 |
| 8,256,356 | B2 * | 9/2012 | Fremming | A47B 37/00<br>108/139 |
| 8,671,644 | B2 * | 3/2014 | Huang | A47B 13/06<br>108/155 |
| 10,288,096 | B2 * | 5/2019 | Del Missier | F16B 1/00 |
| 2002/0043183 | A1 * | 4/2002 | Insalaco | A47B 21/06<br>108/50.02 |
| 2003/0136313 | A1 * | 7/2003 | Griepentrog | A47B 21/06<br>108/50.02 |
| 2009/0284655 | A1 * | 11/2009 | Lukes | A47B 21/007<br>348/552 |
| 2012/0145048 | A1 * | 6/2012 | Gao | A47B 21/00<br>108/28 |
| 2014/0331901 | A1 * | 11/2014 | Seefeldt | A47B 21/06<br>108/50.02 |

* cited by examiner

ARTICLE OF FURNITURE

TECHNICAL FIELD

This disclosure relates, generally, to an article of furniture and, more particularly but not necessarily exclusively, to an article of furniture in the form of a table or desk.

BACKGROUND

Many tables or desks have electrically powered accessories arranged on them. A problem with such an arrangement is that the electrical power cords for the accessories lie across the surface or over the edge of the table or desk creating an unsightly appearance. This problem is sometimes overcome by creating an opening in the tabletop or desktop through which the cords are directed. Sometimes such an opening is covered by a cap member but this can also be unsightly.

Further, the cables may hang over the edge of the desk or table and there is a risk of people catching on the cables which can either cause injury or damage to equipment.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY

In some aspects of the disclosure, there is provided an article of furniture which includes a top member defining a planar work surface;

a support structure for supporting the top member in spaced relationship relative to a floor, the support structure including a plurality of legs, at least one of the legs defining a socket having an opening at a top of the at least one of the legs; and a power connector arranged within the socket of the at least one of the legs, the power connector being configured to make electrical contact with an electrical connector of an electrical accessory when the electrical connector is received in the socket of the at least one of the legs.

The at least one of the legs may be arranged outwardly of a periphery of the top member, a top of the leg lying substantially in the same plane as the work surface of the top member. Each of the legs may be arranged outwardly of the periphery of the top member, a top of each leg lying substantially in the same plane as the work surface of the top member and each leg carrying a power connector.

The support structure may comprise a framework having a plurality of discrete frame members, the framework being dimensioned to be contained within the periphery of the top member.

Each leg may comprise a leg assembly, each leg assembly comprising an extension member extending from the framework and a leg member, the extension member being dimensioned so that the leg member is arranged outwardly of the periphery of the top member. Each leg assembly may comprise a cylindrical carrier arranged at a free end of the extension member, the carrier carrying the power connector and defining the socket and the carrier being configured to mount the leg member.

A receiving formation may be arranged within the socket of the carrier, the receiving formation receiving the power connector. Further, a knock-in may be received within the socket of the carrier snugly to receive the mounting formation of the electrical accessory.

The extension member and each frame member may define channels through which electrical conductors for providing electrical power to the power connector extend in a concealed manner.

The leg assembly may include a joiner which is interposed between, and interconnects, two of the discrete frame members, the extension member forming a part of the joiner. The joiner may comprise a pair of diverging limbs, the extension member extending from a junction of the limbs and a free end of each limb and an end of its associated frame member carrying complementary connecting formations. The connecting formations may be, firstly, a tongue projecting from the free end of each limb and, secondly, a channel defined in the end of the frame member, the tongue being received in the channel.

An extension member or at least one limb of at least one of the joiners or at least one frame member may carry a retaining element, the retaining element being located on an operatively underside of the extension member, the at least one limb or the at least one frame member and the retaining element may be configured to retain a power cord from a wall socket in a substantially concealed manner, in use. In an embodiment, each of the limbs and the extension member of each joiner and each frame member may carry a retaining element. The retaining element may be in the form of a clip.

The at least one leg may include a closure member for closing off the opening in the top of the leg when an electrical accessory is not carried by that leg.

At least one drawer may be arranged beneath the top member. The drawer may be arranged on runners suspended from the top member.

The article of furniture may include a control unit carried, and at least partially concealed, by the support structure. The control unit may be arranged in a receptacle mounted to one of the frame members of the framework of the support structure. In an embodiment, the control unit may include at least one electrical mains supply outlet.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF DRAWINGS

Embodiments of the disclosure are now described by way of example with reference to the accompanying diagrammatic drawings in which: —

DETAILED DESCRIPTION OF EXEMPLARY EMBODIMENTS

Figure 1:
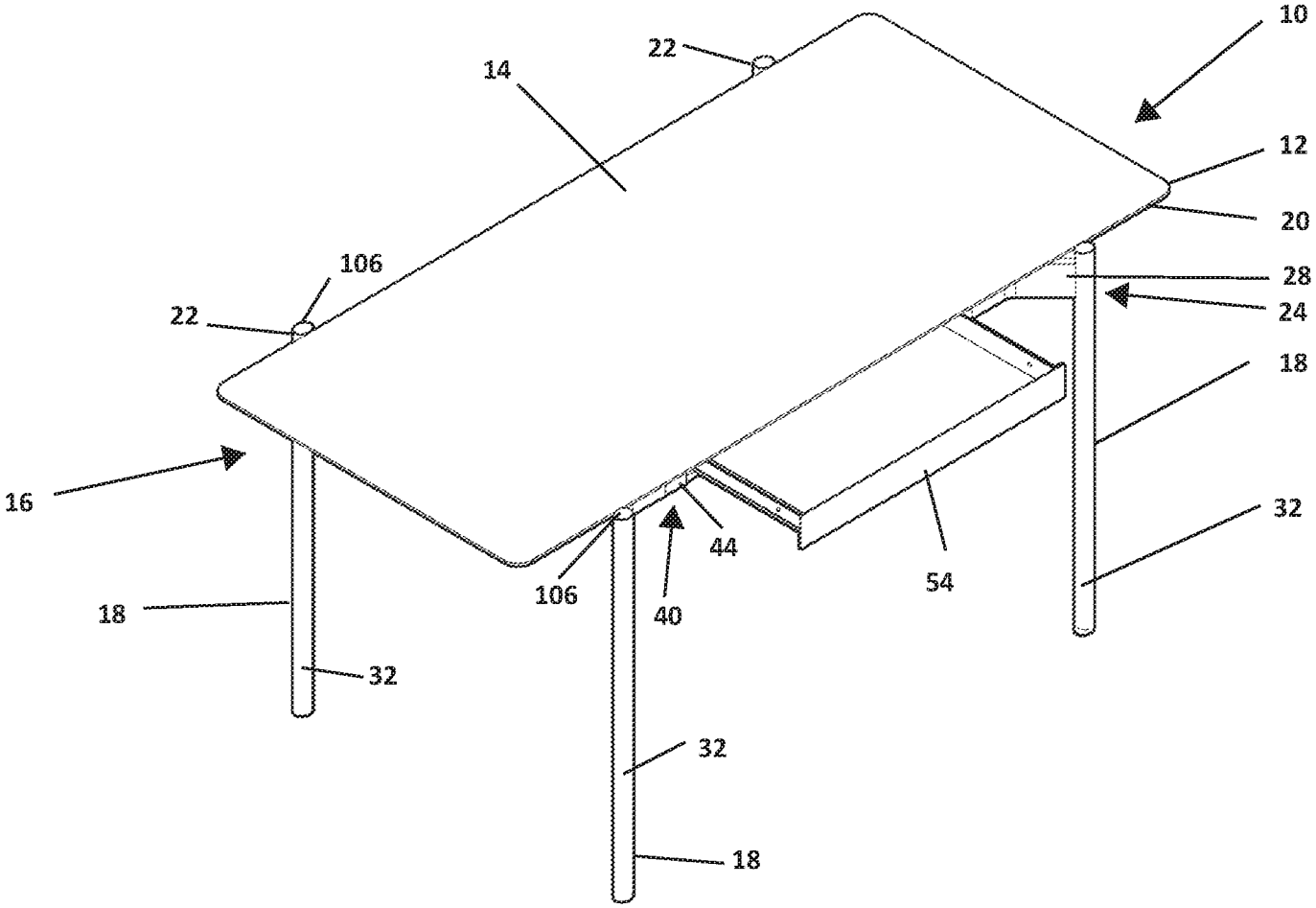
FIG. 1 shows a perspective view of an embodiment of an article of furniture in the form of a desk with a drawer of the desk shown in a partially open configuration.

In the drawings, reference 10 generally designates an embodiment of an article of furniture. In the described embodiments, the article of furniture 10 is in the form of a desk. Those skilled in the art will appreciate that, in other embodiments, the article of furniture could be a table, such as a dining table, a coffee table, or the like.

The desk 10 includes a top member, or table top, 12 defining a planar working surface 14. The table top 12 is supported by a support structure 16. The support structure 16, in use, supports the table top 12 in spaced relationship relative to a floor or other horizontal surface. The support structure 16 includes a plurality of legs 18. The table top 12 has a periphery 20 and the legs 18 are positioned outwardly of the periphery 20 of the table top 12. Further, a top 22 of each leg 18 lies substantially in the same plane as the work surface 14 of the table top 12.

Each leg 18 is in the form of a leg assembly 24 comprising an extension member, or spar, 28 (FIGS. 7-9) which forms part of a joiner 30 as will be described in greater detail below. The leg assembly 24 further includes a leg member 32 (FIG. 12) carried on a carrier 34 arranged at a free end of the spar 28.

A power connector, in the form of a female connector, 36 (FIGS. 8 and 9) is arranged within an interior of the carrier 34 of each leg 18. The connector 24 is accessible via an opening 26 (FIG. 7) defined in a top of the carrier 34 and, hence, the leg 18. As illustrated most clearly in FIGS. 7-9 of the drawings, the connector 24 is arranged in a socket 38 defined by the carrier 34.

Figure 10:
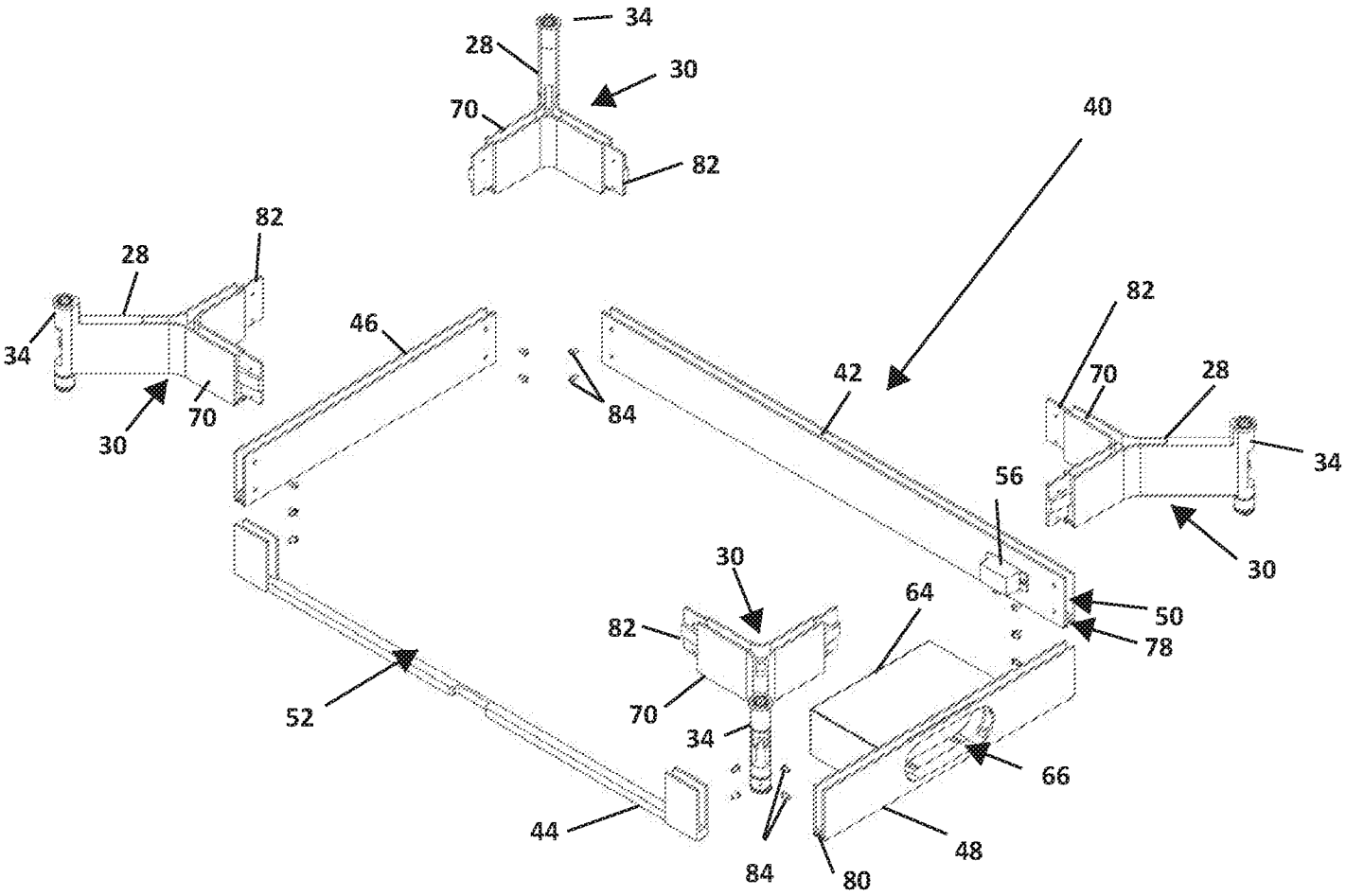
FIG. 10 shows a perspective, exploded view of a framework forming a part of a support structure of the article of furniture.

The support structure 16 further includes a framework 40 (FIG. 10) which is dimensioned to be contained within the periphery 20 of the table top 12 of the desk 10 to be substantially concealed by the table top 12.

In the illustrated embodiment, the table top 12 is rectangular and, accordingly, the framework 40 comprises a rectangular box frame having a pair of laterally spaced side members 42 and 44 and a pair of longitudinally spaced end members 46 and 48. Each side member 42, 44 is connected to the end members 46, 48 by a pair of spaced joiners 30 to make up the framework 40. The arrangement is such that, as clearly shown in FIG. 1 of the drawings, each leg 18 is arranged outwardly of the periphery 20 of the table top 12 of the desk 10 and the framework 40 is substantially concealed beneath the table top 12.

While the illustrated embodiment shows a rectangular desk 10, the disclosure is equally applicable to articles of furniture having other shapes, for example, circular, oval, or other polygonal shapes. It will be appreciated that, for articles of furniture having different shapes, the framework 40 will be correspondingly shaped. Thus, in the case of a circular table top, the framework would also be circular with the spars 28 of the leg assemblies 34 extending radially outwardly from the framework 40.

Figure 16:
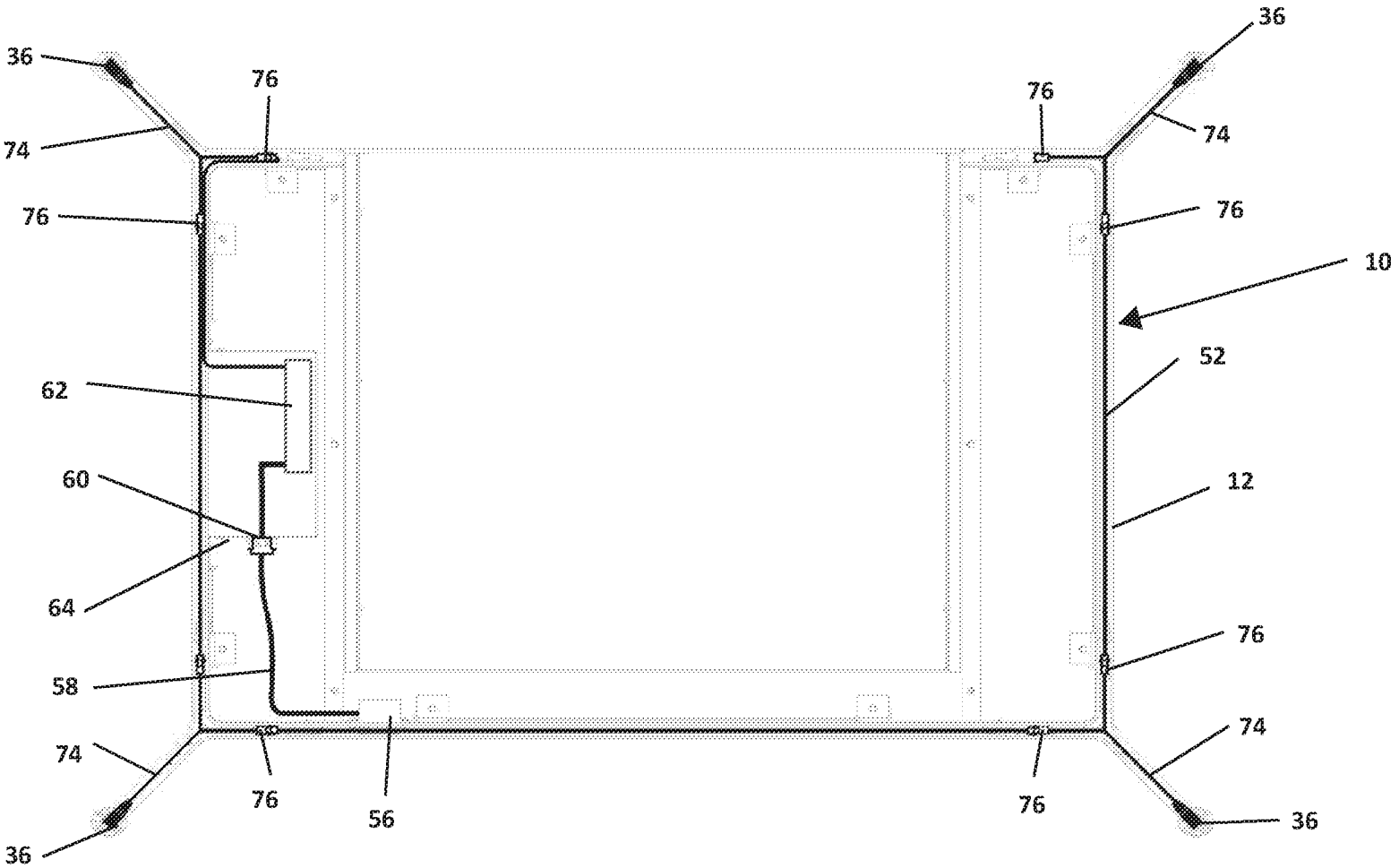
FIG. 16 shows a schematic, wiring diagram of the article furniture.

Each frame member 42-48 is a substantially U-shaped element defining a channel 50 in which electrical cabling 52 (FIG. 16) is received to be concealed and not readily visible or accessible externally of the desk 10.

In the illustrated embodiment, the frame member 44 defines a cutaway portion 52 to accommodate a drawer 54 (shown in a partially open configuration in FIG. 1 of the drawings). The drawer 54 is suspended from the underside of the table top 12 and runs on runners (not shown) extending parallel to the end members 46, 48 of the framework 40.

Figure 15:
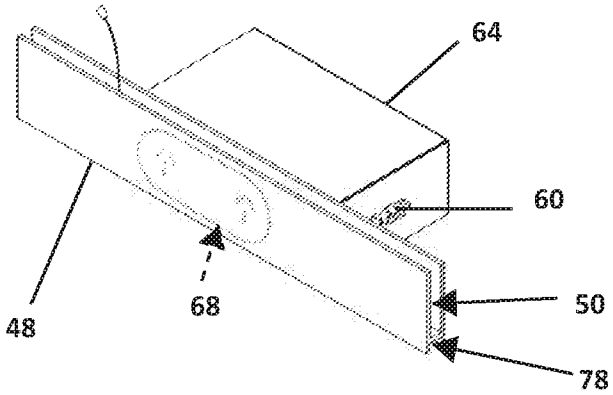
FIG. 15 shows a perspective view of another embodiment of the part of the electrical control arrangement of the article of furniture.

In other embodiments, the drawer 54 may be omitted and, in such an embodiment, the frame member 44 will have substantially the same shape and configuration as the frame member 42. It is to be noted that, in the illustrated embodiment, the frame member 42 carries a power socket 56 via which electrical power is supplied from a wall outlet (not shown) to a control unit 62 of the desk 10. The power socket 56 is connected via a cable 58 (FIG. 16) and a connector 60 to the control unit 62. The control unit 62 is housed in a receptacle 64 carried by the end member 48. In the embodiment illustrated in FIG. 10 of the drawings, the end member 48 is illustrated with an aperture 66 defined therein. The aperture 66 is intended for receiving a set of mains electrical power outlets 68 (FIG. 15).

Figure 14:
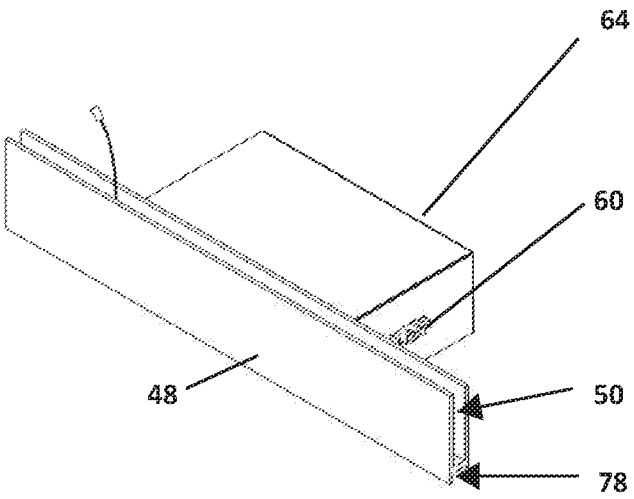
FIG. 14 shows a perspective view of the electrical control arrangement of the article of furniture.
Figure 13:
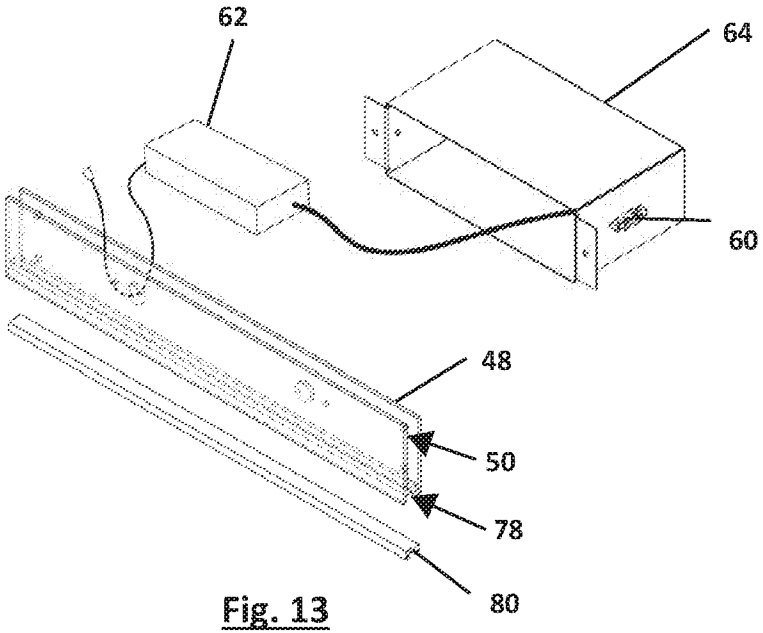
FIG. 13 shows a perspective, exploded view of an electrical control arrangement of the article of furniture.

In other embodiments, the set of electrical power outlets 68 is omitted as shown in the embodiment of FIGS. 13 and 14 of the drawings.

Figure 8:
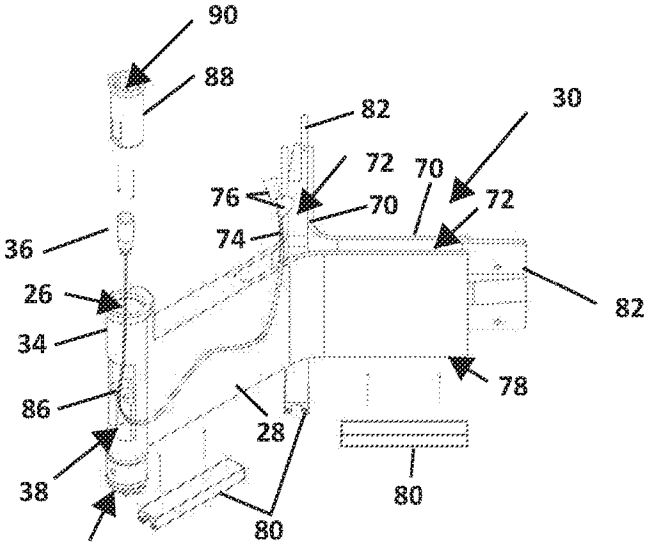
FIG. 8 shows a perspective, exploded view of the joiner and components.
Figure 7:
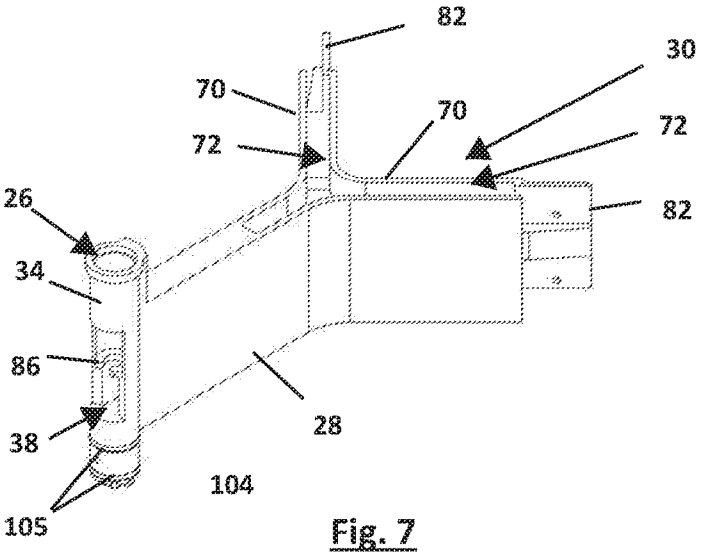
FIG. 7 shows a perspective view of a joiner of the article of furniture, the joiner including a part of the leg assembly.
Figure 9:
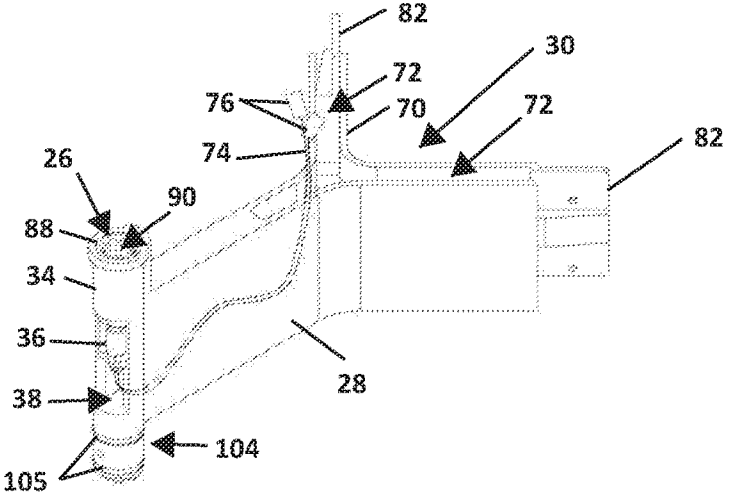
FIG. 9 shows the joiner with the components mounted in position in the joiner.

Reverting now to FIGS. 7-9 of the drawings, the joiner 30 is described in greater detail. The joiner 30 is substantially Y-shaped having a pair of limbs 70 diverging from the spar 28. Each limb 70 defines a first channel 72 through which electrical conductors 74 extending from the power connector 36 can pass for connection via contacts 76 with other parts of the cabling 52 of the desk 10.

While not clearly shown in FIGS. 7-9 of the drawings, each limb 70 and the spar 28 define a second channel 78 in each of which a retaining member in the form of a clip 80 (FIG. 8) is received. Each clip 80 is adhesively secured within its associated channel 78. It is further to be noted that each frame member 42, 46 and 48 of the framework 40 includes a similar channel 78 in each of which a clip 80 is received as shown in respect of the frame member 48 in FIGS. 13-15 of the drawings. The clip 80 is dimensioned to accommodate a power cord (not shown) in a substantially concealed manner, the power cord providing power from a wall socket.

Each limb 70 carries a tongue 82 at its free end. The tongue 82 is offset with respect to the channel 72 to allow passage of the conductors 74. The tongues 82 are used to locate and mount adjacent frame members 42 and 48, 42 and 46, 44 and 46 and 44 and 48 together. Fasteners, such as grub screws, 84 are used to fasten the relevant limb 70 to its associated frame member 42-48.

Figure 3:
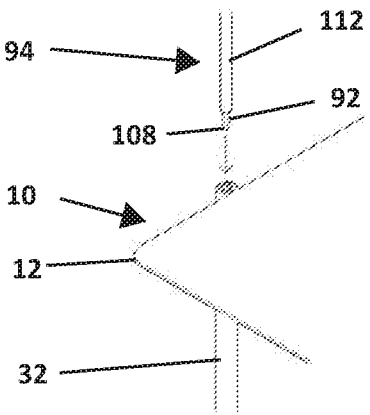
FIG. 3 shows a perspective, exploded view of a part of a first electrical accessory being inserted into the leg assembly of the article of furniture.

A receiving formation, in the form of a collar, 86 is arranged within the socket 38 of the carrier 34. The collar 86 is dimensioned to accommodate the power connector 36. The power connector 36 is further retained in position by a knock-in 88 inserted into a top of the carrier 34 via the opening 26 in the top of the carrier 34. The knock-in 88 defines a passage 90 which is dimensioned to receive a stub 92 (FIG. 3) of an electrical accessory 94 snugly as will be described in greater detail below.

Figure 12:
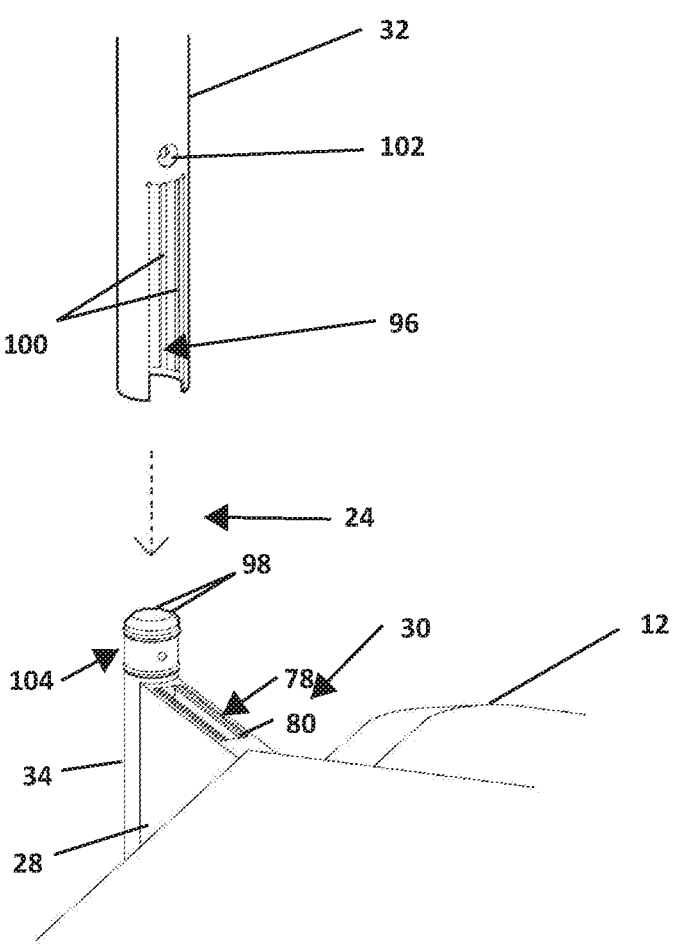
FIG. 12 shows, on an enlarged scale, a perspective, underside view of the article of furniture illustrating the mounting of the leg member of the leg assembly to the joiner.
Figure 11:
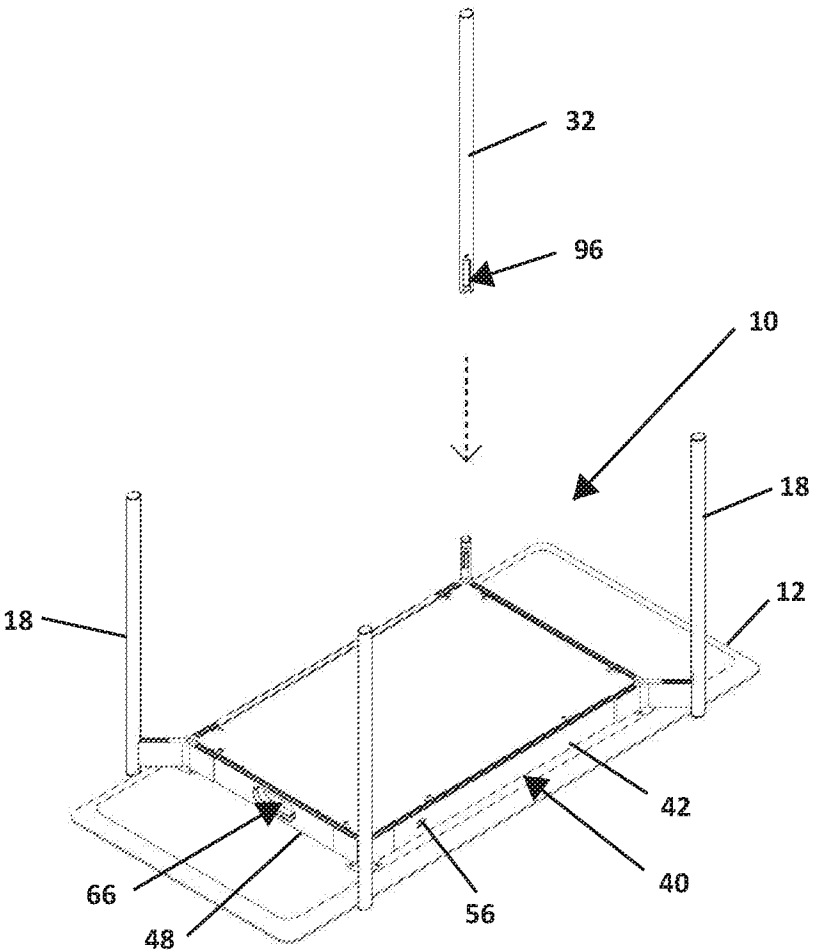
FIG. 11 shows a perspective, underside view of the article of furniture illustrating the mounting of the leg member of the leg assembly to the joiner.

An operatively top region of each leg member 32 is slotted as shown at 96 in FIG. 12 of the drawings. The leg member 32, in use, is slid over the carrier 34 and the slot 96 allows the leg member 32 to clear the spar 28 of its associated joiner 30. To ensure that the leg member 32 is correctly orientated relative to the carrier 34, the carrier 34 has a pair of radially spaced longitudinally extending ribs 98 (FIG. 12) which cooperate with longitudinally extending grooves 100 defined in an inner surface of the operatively top region of the leg member 32. The leg member 32 is secured to its associated carrier via a fastener, such as a grub screw (not shown) received in a threaded opening 102 arranged operatively beneath the slot 96 of the leg member 32.

The carrier 34 carries a sealing arrangement 104 in the form of a pair of spaced O-rings 105 to inhibit the ingress of detritus into the leg member 32. The O-rings 105 further serve to retain the leg member 32 in position on the carrier 34 by frictionally abutting the inner surface of the leg member 105.

Figure 2:
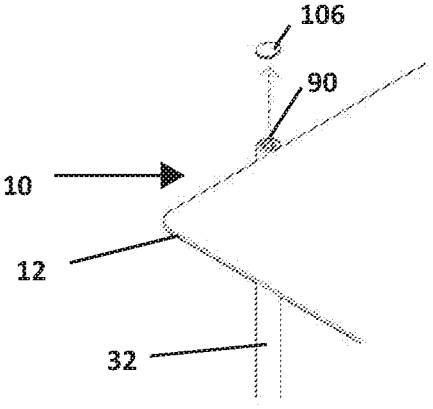
FIG. 2 shows a perspective, exploded view of a part of a leg assembly of the article of furniture illustrating a cover member of the leg assembly.

When a leg 18 of the desk 10 is not being used to mount an electrical accessory, the opening to the passage 90 of the knock-in 88 is closed off by a closure member, or cover, 106 (FIG. 2). This improves the aesthetics of the desk 10. At least the top of the leg 18 has a generally oval periphery and the cover 106 has a similarly oval periphery to cover the top of the leg 18.

The stub 92 of the electrical accessory 94 carries a male connector 108. The male connector 108 electrically connects to the female power connector 36 to receive electrical power via the cabling 52 of the desk 10. The control unit 62 receives mains power and transforms that mains power into a 12 V DC signal provided to the power connectors 36 of the desk 10.

In use, power is supplied to the control unit 62 of the desk 10 from a wall socket and an electrical cord plugged into the power socket 56 of the desk. The cord is retained in position beneath the table top 12 by being clipped into one or more of the clips 80 running beneath the framework 40.

Figure 4:
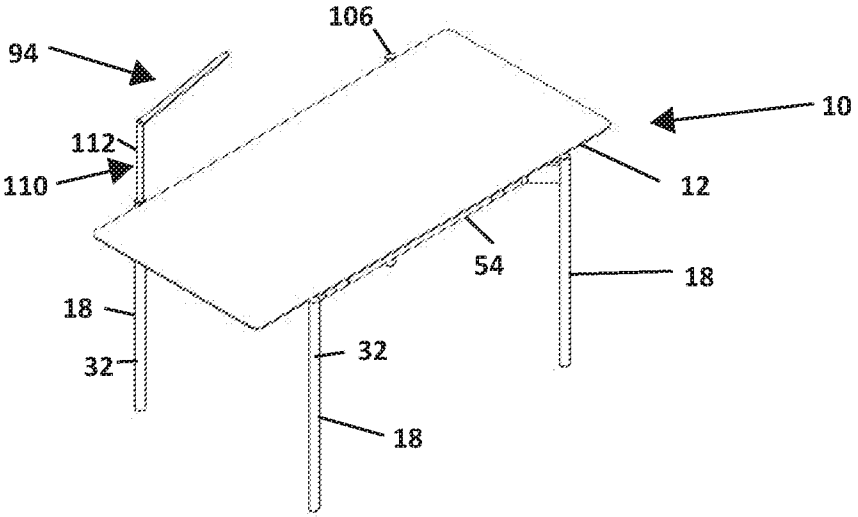
FIG. 4 shows a perspective view of the article of furniture with the first electrical accessory mounted to it.

An electrical accessory 94 is mounted to one of the leg assemblies 24 by, firstly, removing the cover 106 from the top of the leg member 32 of the selected leg assembly. In the embodiment illustrated in FIGS. 3 and 4 of the drawings, the electrical accessory is a lamp 110 having a stem 112 from which the stub 92 and the male connector 108 project. The stub 92 is inserted into the exposed passage 90 of the knock-in 88 until the connectors 108 and 36 make electrical contact so that electrical power is supplied to the lamp 110 from the control unit 62.

Figure 6:
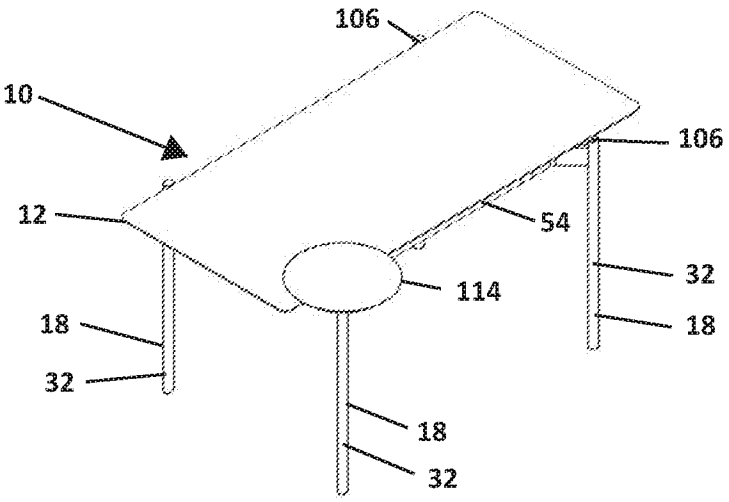
FIG. 6 shows a perspective view of the article of furniture with the second electrical accessory mounted to it.
Figure 5:
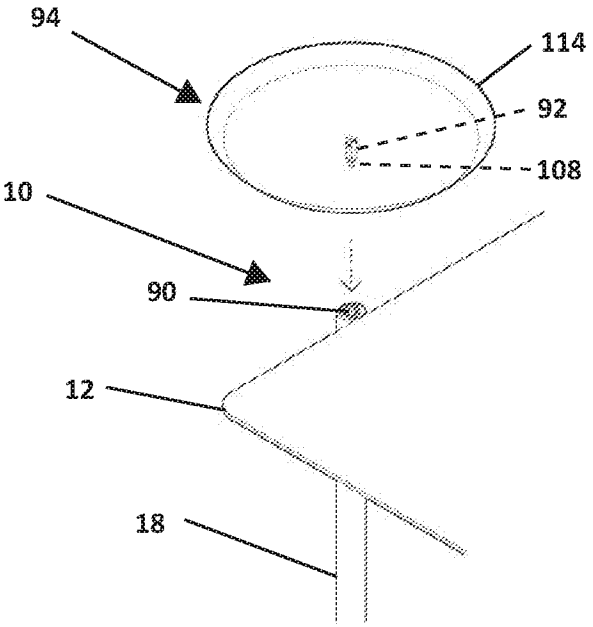
FIG. 5 shows a perspective, exploded view of a second electrical accessory being inserted into the leg assembly of the article of furniture.

In the embodiment shown in FIGS. 5 and 6 of the drawings, the electrical accessory 94 is a table 114 containing a charging unit (not shown) for wirelessly charging an electronic device such as a mobile telephone. The table 114 includes the stub 92 and male connector 108. The table 114 is mounted to the leg member 32 in the same manner as described above with reference to the lamp 110.

It will be appreciated that other electrical accessories 94 can be mounted to the leg members 32 of the leg assemblies 24 in a similar manner to that described above. Other examples of electrical accessories 94 include speakers, fans, or the like. It is also to be noted that the control unit 62 is configured to supply electrical power to more than one electrical accessory at a time. Thus, for example, the lamp 110 may be mounted to one of the leg assemblies 24 while the charging table 114 is mounted to another of the leg assemblies 24

When any of the covers 106 are removed, the covers 106 can be stored in the drawer 54 of the desk 10. In certain circumstances, the drawer 54 can also be used for accommodating the electrical accessories 94 assuming that such electrical accessories are dimensioned to fit within the drawer 54.

It is a particular advantage of the described embodiments, that an article of furniture is provided which has improved aesthetics as electrical cabling and connectors are largely concealed. This also improves safety as there is less risk of catching on cabling etc.

Still further, the leg members 32 are removable so that the article of furniture 10 can be packed in a flat pack for storage or transportation purposes and can be easily assembled by the purchaser with a minimum number of tools being required to do so. In addition, no expertise is required to connect electrical accessories 94 to the article of furniture 10.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. An article of furniture which includes a top member defining a planar work surface;

a support structure comprising a framework, the support structure supporting the top member in spaced relationship relative to a floor, the support structure including a plurality of legs, at least one of the legs defining a socket having an opening at a top of the at least one of the legs, each leg comprising a leg assembly and each leg assembly comprising:

an extension member extending from the framework; and a leg member, the extension member being dimensioned so that the leg member is arranged outwardly of a periphery of the top member; and a power connector arranged within the socket of the at least one of the legs, the power connector being configured to make electrical contact with an electrical connector of an electrical accessory when the electrical connector is received in the socket, the leg assembly of the at least one of the legs comprising a cylindrical carrier arranged at a free end of the extension member, the carrier carrying the power connector and the carrier defining the socket, and the carrier further mounting the leg member to the extension member.

2. The article of furniture of claim 1 in which the top of the legs lies substantially in the same plane as the work surface of the top member.

3. The article of furniture of claim 2 in which a top of each leg lies substantially in the same plane as the work surface of the top member and each leg carries a power connector.

4. The article of furniture of claim 3 in which the framework has a plurality of discrete frame members, the framework being dimensioned to be contained within the periphery of the top member.

5. The article of furniture of claim 4 in which the extension member and each frame member define channels through which electrical conductors for providing electrical power to the power connector extend in a concealed manner.

6. The article of furniture of claim 4 in which each leg assembly includes a joiner which is interposed between, and interconnects, two of the discrete frame members, the extension member forming a part of the joiner.

7. The article of furniture of claim 6 in which the joiner comprises a pair of diverging limbs, the extension member extending from a junction of the limbs and a free end of each limb and an end of its associated frame member carrying complementary connecting formations.

8. The article of furniture of claim 6 in which the extension member or at least one limb of at least one of the joiners or at least one frame member carries a retaining element, the retaining element being located on the extension member, the at least one limb or the at least one frame member and the retaining element being configured to retain a power cord from a wall socket in a substantially concealed manner, in use.

9. The article of furniture of claim 1 in which a receiving formation is arranged within the socket of the carrier, the receiving formation receiving the power connector.

10. The article of furniture of claim 1 in which the legs includes a closure member for closing off the opening in the top of the leg when an electrical accessory is not carried by that leg.

11. The article of furniture of claim 1 in which at least one drawer is arranged beneath the top member.

12. The article of furniture of claim 1 which includes a control unit carried, and at least partially concealed, by the support structure.

* * * * *